US007409963B2

(12) United States Patent
Mallookis et al.

(10) Patent No.: US 7,409,963 B2
(45) Date of Patent: Aug. 12, 2008

(54) CORNER MOLDING AND STOP ASSEMBLY FOR COLLAPSIBLE SHELTER

(75) Inventors: Steven E. Mallookis, Littleton, CO (US); Chao-Shun Ko, Taipei (TW)

(73) Assignee: Go Papa, LLLP, Littleton, CO (US)

( * ) Notice: Subject to any disclaimer, the term of this patent is extended or adjusted under 35 U.S.C. 154(b) by 366 days.

(21) Appl. No.: 10/983,005

(22) Filed: Nov. 5, 2004

(65) Prior Publication Data

US 2006/0096631 A1 May 11, 2006

(51) Int. Cl.
*E04H 15/48* (2006.01)

(52) U.S. Cl. ..... 135/144; 135/131; 135/140; 135/161; 403/109.3; 403/171; 403/217

(58) Field of Classification Search ..... 135/121–122, 135/131, 139–146, 909, 135, 161; 403/109.3, 403/217, 170–172, 161–163, 109.7; 52/641, 52/646; 248/166–167; 16/324, 326
See application file for complete search history.

(56) References Cited

U.S. PATENT DOCUMENTS

| | | | | | |
|---|---|---|---|---|---|
| 1,185,568 | A * | 5/1916 | Zeunert | 248/436 |
| 4,298,095 | A * | 11/1981 | Jackson et al. | 182/182.4 |
| 4,641,676 | A | 2/1987 | Lynch | |
| 4,890,634 | A | 1/1990 | Dalo et al. | |
| 5,000,211 | A | 3/1991 | Spears et al. | |
| 5,035,253 | A | 7/1991 | Bortles | |
| 5,035,527 | A * | 7/1991 | Cheng | 403/109.5 |
| 5,167,246 | A * | 12/1992 | Mortenson | 135/153 |
| 5,234,011 | A | 8/1993 | Lynch | |
| 5,274,980 | A | 1/1994 | Zeigler | |
| 5,278,188 | A | 1/1994 | Tsai | |
| 5,421,356 | A * | 6/1995 | Lynch | 135/145 |
| 5,490,532 | A | 2/1996 | Mallookis | |
| 5,638,853 | A * | 6/1997 | Tsai | 135/145 |
| 5,794,640 | A * | 8/1998 | Jang | 135/131 |
| 6,152,157 | A | 11/2000 | Jang | |
| 6,382,224 | B1 * | 5/2002 | Carter | 135/145 |
| 6,478,039 | B2 | 11/2002 | Suh | |
| 6,508,262 | B1 | 1/2003 | Takiyama | |
| 6,551,226 | B1 * | 4/2003 | Webber et al. | 482/148 |
| 6,575,656 | B2 | 6/2003 | Suh | |
| 6,772,780 | B2 * | 8/2004 | Price | 135/131 |
| 6,792,880 | B2 * | 9/2004 | Tsai | 108/115 |
| 6,848,461 | B2 * | 2/2005 | Tsai | 135/131 |
| 6,913,231 | B2 * | 7/2005 | Speggiorin | 248/169 |
| 6,951,327 | B1 | 10/2005 | Seo | |
| 7,097,380 | B2 * | 8/2006 | Lee | 403/109.2 |
| 2005/0249545 | A1 * | 11/2005 | Tsai | 403/109.3 |
| 2006/0051159 | A1 * | 3/2006 | Tsai | 403/109.3 |

* cited by examiner

*Primary Examiner*—Winnie Yip
(74) *Attorney, Agent, or Firm*—The Reilly Intellectual Property Law Firm, P.C.; Ellen Reilly

(57) ABSTRACT

A collapsible shelter of the type having a canopy and a frame, the frame having mounting members with a stabilizer, reduced friction pivot shafts and an adjustable locking member having a spring providing for easy adjustment of the height and breadth of the canopy.

26 Claims, 9 Drawing Sheets

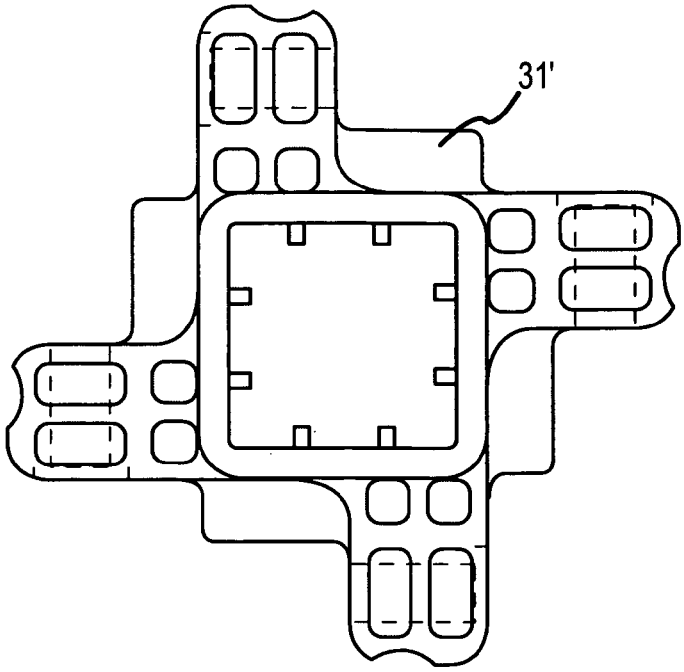
FIG.8
FIG.9
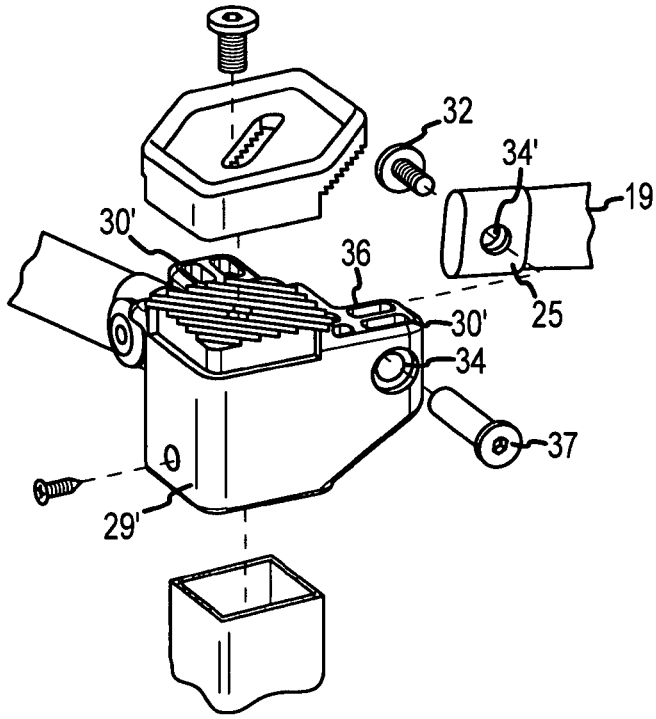

CORNER MOLDING AND STOP ASSEMBLY FOR COLLAPSIBLE SHELTER

BACKGROUND AND FIELD OF INVENTION

This invention relates to shelters; and more particularly relates to a collapsible shelter which has novel and improved mounting supports providing added stability as well as a novel push pin assembly on side support legs which provides for ease of use.

Shelter assemblies having a canopy, collapsible frame with corner legs and a center support are in widespread use. The trend now has been to construct collapsible shelters that are lightweight and can be assembled quickly by a single person. A problem confronting users of collapsible shelters is that the lightweight design is not always as stable as its heavier counterparts. The truss sections are subject to buckling as well as overextension or misalignment of the arm members mounted on the corner legs and center support. Further, collapsible shelters have incorporated pull pin technology such as in U.S. Pat. No. 6,508,262 to Takiyama or the pull pin assembly in U.S. Pat. No. 6,575,646 to Suh. The pull pin assemblies are typically used for adjustment of the side support legs as well as for increasing the angle of extension of canopy support arms and locking them in place. Another type of adjustable locking mechanism is a simple pushbutton which is well known in the prior art. The pull pin assemblies and the pushbutton mechanism require two hands for operation of the devices. Further, the pushbutton system requires significant thumb pad pressure to allow release of the button which in turn can result in a pinched finger or minor injury. There is an unmet need for a lightweight yet stable collapsible shelter incorporating an adjustment assembly for adjusting the height of the canopy which only requires one hand for operation of the device and is easy to use; and further to provide for a novel and improved shelter with added stability and alignment of the shelter frame members.

SUMMARY OF THE INVENTION

It is therefore an object of the present invention to provide for a novel and improved shelter which is lightweight and highly efficient in use.

It is another object of the present invention to provide for novel and improved mounting members which provide added stability to the shelter framework and avoid overextension of the arm members.

It is an additional object of the present invention to provide in a collapsible shelter an adjustable locking mechanism which is easy to use and enables height adjustment of the shelter without injury.

It is a final object of the present invention to provide in a collapsible shelter an adjustable locking mechanism which slides easily into place with reduced tension.

In accordance with the present invention, there is provided in a shelter of the type having a canopy and a frame with support members including vertical support legs at spaced peripheral intervals beneath the canopy, a center telescoping support extending upwardly from the frame into engagement with an undersurface portion of the canopy at its center, truss sections extending from the vertical support legs and the center support, truss mounts and pairs of scissor-like arm members with upper and lower terminal ends mounted on the center support and the vertical legs, the improvement comprising mounting members for securing the terminal ends of the arm members to the support members, each mounting member having at least one boss, and means for pivotally connecting the arm members to the bosses, the means including a bolt member threadedly engaging a hollow shaft member extending through the boss. In one form, the boss includes a stabilizer member for wedging or locking the arm members in predetermined angular relation to the mounting members. Additionally, there is an adjustable locking member for positioning the telescoping members or frame members into a locked position at the desired height which include a right angle lever control including a release pin and a spring member mounted under compression between the right angle lever control and the base mounting member, the spring member resiliently urging the right angle lever control in a direction causing the release pin to engage mutually aligned bores on telescoping members.

The above and other objects, advantages and features of the present invention will become more readily appreciated and understood from a consideration of the following detailed description of preferred and modified forms of the present invention when taken together with the accompanying drawings in which:

BRIEF DESCRIPTION OF THE DRAWINGS

FIG. 8 is a top plan view of the center mounting assembly shown in FIG. 7;

FIG. 9 is an exploded view of a corner mounting assembly;

DETAILED DESCRIPTION

Figure 1:
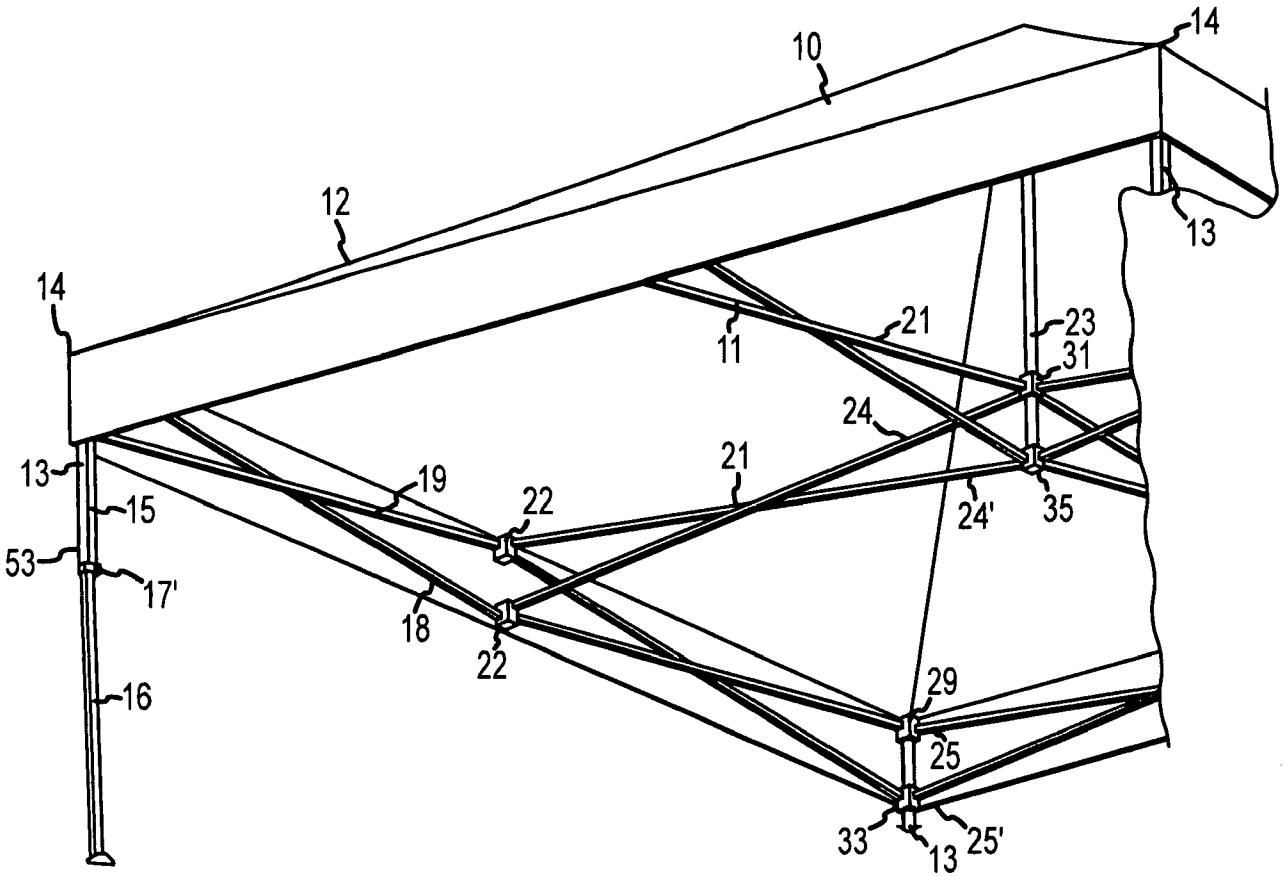
FIG. 1 is a perspective view of one form of shelter in accordance with the present invention.
Figure 2:
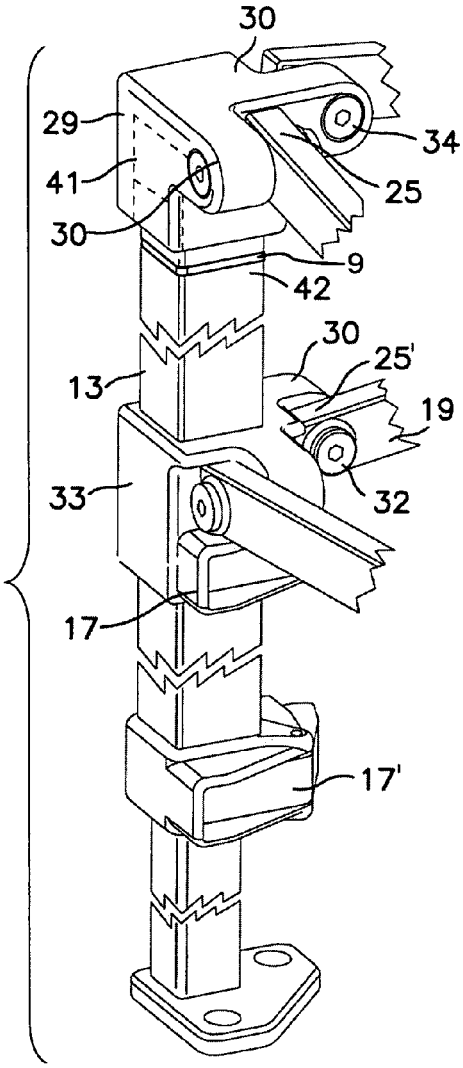
FIG. 2 is a perspective view of a corner mounting assembly including a slider mount forming a part of the present invention.
Figure 4:
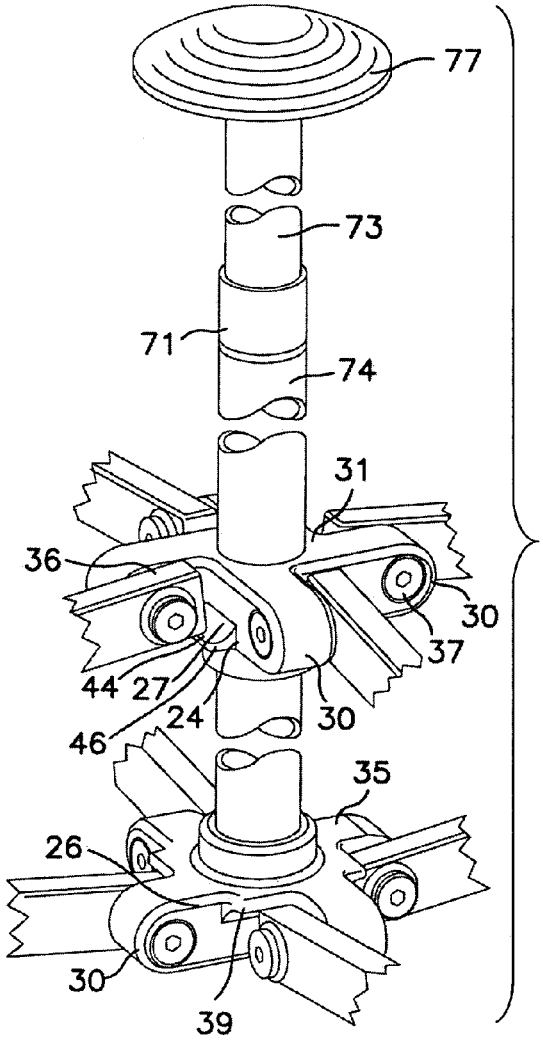
FIG. 4 is a perspective view of a center mounting assembly forming a part of the present invention.

Referring in more detail to the drawings, there is shown in FIG. 1 a form of shelter 10 broadly comprised of a collapsible frame assembly 11 including a canopy 12 typically of canvas composition and of a generally polygonal configuration with four corners 14 (three shown). The frame 11 has four vertical support legs 13 at spaced peripheral intervals beneath the canopy 12. Each vertical support leg 13 has upper and lower telescoping members 15 and 16 which are of square cross-section and provided with an adjustable locking member 17 to regulate the length of extension or height of the canopy. The adjustable locking member 17 will be discussed in more detail at a later point. The frame 11 has outer peripheral truss sections 18 made up of two pair of scissors-like pivotal arm members 19 in end-to-end relation to one another between adjacent corners of the frame with connectors or truss mounts 22 between adjoining ends of the arm members 19; and radial truss sections 21 extending between a center support tube 23 and adjoining ends of the arm members 19 at the truss mounts 22 of each outer peripheral truss section 18. These truss sections are well known in the prior art. Each upper terminal end 25 of the outer peripheral truss sections 18 is secured by a corner mounting member 29 and each lower terminal end 25' is secured by a slider mount 33 to the corner support legs 13, as shown in FIGS. 1 and 2. The radial truss sections 21 have inner upper and lower ends 24 and 24' of the arm members 19 secured to upper and lower center mounting members 31 and 35, respectively, as shown in FIGS. 1 and 4.

Figure 3:
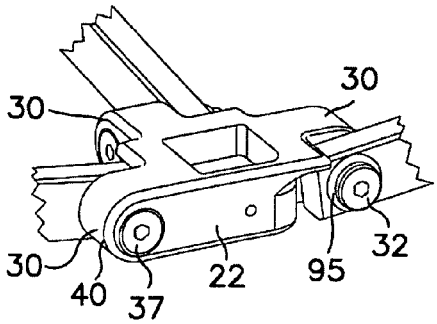
FIG. 3 is a perspective view of a truss mount forming a part of the present invention.

As shown in FIG. 1, the arm members 19 conventionally have upper extremities connected to the truss mount 22, shown in FIG. 3, the corner mounting member 29 or the upper center mounting member 31. Lower extremities of the arm members 19 are connected to the truss mount 22, the slider mount 33 on the vertical support leg 13 or the lower center mount member 35, as shown in FIGS. 2, 3 and 4. The slider mounts 33 can be released to permit collapse of the canopy into a compact folded state which is also well-known in the prior art. The upper and lower center mounting members 31 and 35 as shown in FIG. 4, the corner leg mounting member 29 as shown in FIG. 2, the truss mounts 22 as shown in FIG. 3, and the slider mount 33, as shown in FIG. 2, are preferably made up of a polypropylene compound and include bosses 30 in the form of generally bull-nose shaped lateral projections 40 which receive hollow pivot shafts 32 for pivotally securing the terminal ends 25 and 25' of the arm members 19 to the bosses 30 for pivotal movement about horizontal axes with a minimum of pressure and frictional engagement therebetween. The pivot shaft 32 which is preferably metal is inserted through a washer 95, which is metal or plastic and shown in FIG. 3, an aligned bore 34' in the arm member 19, and an aligned bore 34 in the boss 30. The pivot shaft is closed at one end by an enlarged head 32' and is internally threaded at its opposite end for a predetermined distance to permit threaded insertion of a bolt 37. The pivot shaft 32 has a limited hollow threaded portion to limit the degree of inward threading movement of the bolt 37 to a position such that the aggregate length will hold the end of the arm member 19 against the side of the boss 30 without undue compression. The bolt 37 also includes an enlarged head 37' which is received in a counterbore at the end of the bore 34 in the boss. The washer 95 also prevents the metal pivotal shaft 32 from directly contacting the aluminum arm members 19. There is greatly reduced friction between the arm member 19 and the boss 30 as well as a lack of compression while maintaining uniform alignment of the arm members 19 with the bosses 30.

Figure 5A:
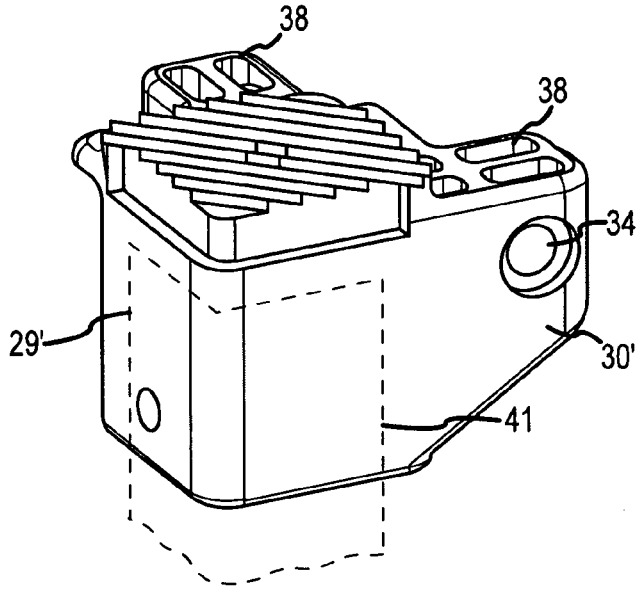
FIG. 5A is a perspective view of an alternate form of corner mounting assembly.
Figure 5B:
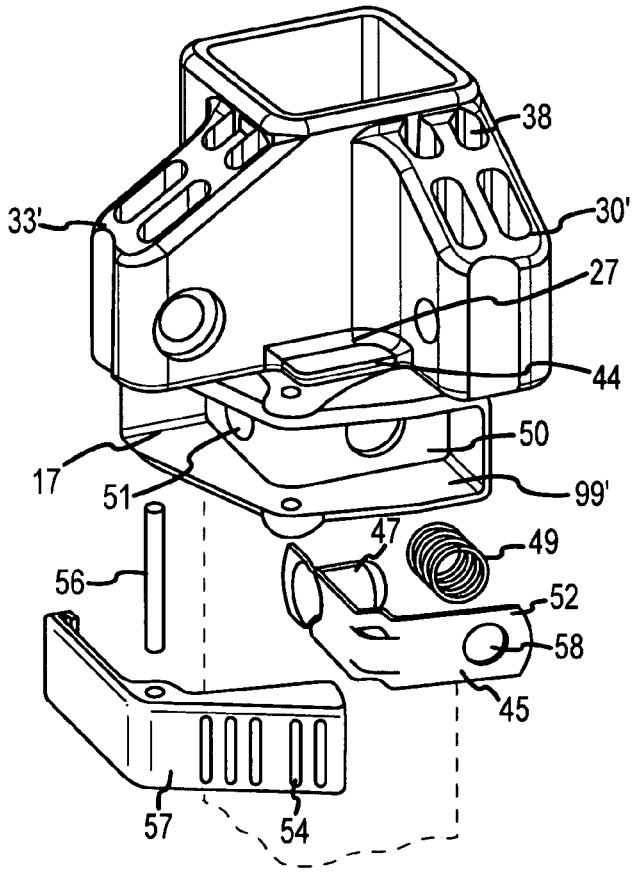
FIG. 5B is a perspective view of an alternate form of corner mounting assembly.
Figure 5C:
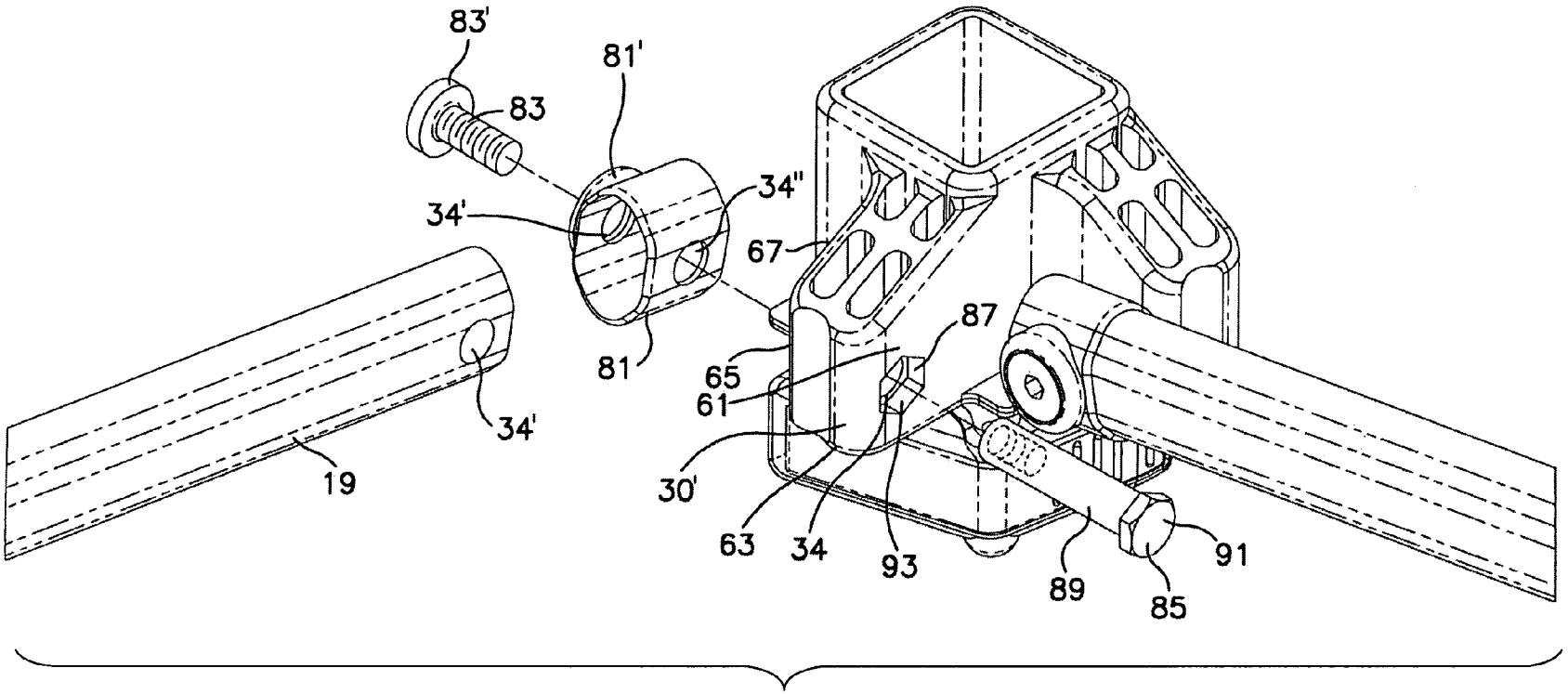
FIG. 5C is an exploded view of the alternate form of invention of FIG. 5 with an alternate form of pivotal attachment.

Another form of pivotal attachment is shown in FIG. 5C demonstrating the arm member 19, a tubular collar 81 with a plastic washer or spacer 81 aligned with openings 34' in the collar 81, and a boss 30' includes aligned bores 34 for insertion of a hollow pivot shaft 89 to threadedly receive a bolt 83 having an enlarged head 83'. The shaft 89 is inserted through the aligned bores 34, 34' and 34" in the arm 19 and the collar 81 until the head 91 is seated in a conforming hexagonal stop or recess 87. The non-circular head 91 of the shaft 89 has a plurality of flat edges 93 which are fixed against rotation in the hexagonal recess 87 and the bolt 83 is threaded into an internally threaded end of the hollow shaft 89. This allows for greater ease of use by a user as tightening or replacing the bolt 83 requires a single wrench and one-handed operation. The boss 30' is in the form of a truncated mounting block having upper or lower sloped or outwardly tapered surfaces. The boss 30' may also have flat parallel sides 61 terminating in a rounded end surface 63, one horizontal end surface 65 and an inclined or truncated end surface 67 with the bore 34 extending transversely through the sides 69. The boss 30' is recessed as shown but of increased size at its point of attachment to the leg support so as to be of increased strength and rigidity in supporting the arm members.

The following is a general description of the mounting assemblies which include the truss mounts 22, the upper and lower center mount members 31, 35, the corner leg mounting member 29 and the slider mount 33. These mounting assemblies are shown in FIGS. 2, 3 and 4 which demonstrate mounting assemblies used in one form of shelter referred to as the UC-4 Model by applicant. It may also be used in other forms of shelter and is not limited to the UC-4 Model. Additional forms of invention are shown in FIGS. 5A, 5B, 6A and 6B. These forms of invention are typically incorporated into larger shelter models, including the UC-2 and UC-3 Models. At least two bosses 301 extend laterally outwardly from the mounting assembly with bores 34 therethrough designed to accommodate the aligned bores 34' on the terminal ends 25 of the arm members 19. See FIG. 9. The mounting assembly includes a stabilizer member which is in the form of stop members 39 and 44 juxtaposed to each boss 30. This is best shown in FIG. 4. The stop member 44 extends laterally outwardly from a side 36 of the boss 30. The stop member 44 has an upper inclined portion 27 providing a relief surface for the terminal ends 25 of the arm members 19 and a lower, outwardly extending portion 46. The terminal ends 25 of the arm members 19 are juxtaposed along the side 36 of the boss 30.

In accordance with standard practice, the scissors-like arm members 19 are collapsible by releasing the slider mounts 33 so as to permit the lower terminal end 25' of each arm member 19 to pivot downwardly away from the upper terminal end 25 and enable the arm members 19 to move into a collapsed position extending substantially parallel to the vertical support legs 13. Conversely, the slider mounts 33 can be raised along the support legs 13 toward the upper corner mounts 29 until the slider mounts 33 reach their upper locked positions. As the slider mounts 33 move into their upper locked positions, the arm members will pivot into firm wedging engagement with the stop members 39 so as to effectively lock the arm members 19 at an angle just short of perpendicular to the legs 13. Similarly, the ends 25 and 25' of the arm members 19 which are pivotally connected to the truss mounts 22 will move into wedging engagement with the stop members 39 and 44 so as to prevent twisting or misalignment of the truss mounts with respect to the arm members, thereby adding stability and the same is true of the inner ends of the arm members 19 at the center mounts 31 and 35 so as to substantially rigidify the entire structure both in the lateral and vertical directions.

The stop member 44 is located along a lower portion 24 of the boss 30 as shown on the upper center mounting member 31 of FIG. 4 or stop member 39 is located along an upper portion 26 of the boss 30 as shown on the lower center mount 35 of FIG. 4. The location of the stop members 39 and 44 are dependent upon the angle of orientation desired for the arm member of the particular mounting assembly. The dimension of the stop members 39 and 44 are dependent upon the length of the arm member 19 as measured from the terminal end 25 and the aligned bore 34'. FIG. 4 demonstrates the alignment of the arm member 18 with respect to stop members 39 and 44 in one form of shelter.

The corner leg mounting member 29, as shown in FIG. 2, includes two bosses 30 extending laterally outwardly at right angles to one another from the mounting member 29. The corner leg assembly 29 includes a square central opening 41 for placement on a terminal end 42 of the support legs 13. As described previously, the bosses 30 extend laterally outwardly from the mounting member 29 and have the aligned bores 34 passing through each boss 30. FIGS. 5A and 5B demonstrate an alternate form of corner leg mounting member 29' having vertical recesses or slot members 38. The boss 30' may include the slot members 38 as shown in FIG. 5A which change the composition of the mounting assembly 29', making it more lightweight, enhances durability and strength as well as creating a precise mounting assembly. Typically, the manufacture of the mounting assembly results in expansion of the resin molding during production. The presence of the slot members 38 reduces the expansion of the assembly resulting in a precisely dimensioned assembly. As described previously and shown in FIG. 9, the terminal ends 25 of the arm members 19 are placed along a side 36 of the boss 30' and have aligned bores 34' located at the terminal end 25 of the arm members 19. The non-compression member 32 is inserted through the aligned bores 34, 34' resulting in a pivotal, reduced frictional connection between the arm member 19 and the boss 30. Also as previously described, the stop member 44 extends laterally outwardly from the side 36 of the boss 30. The stop member 44 includes an upper concave lip or inclined portion 27 and a lower, outwardly extending flat plate portion 44 as shown in FIG. 5B.

FIG. 2 also shows the slider mount 33 including the two bosses 30 extending laterally outwardly from the slider mount 33. The bosses 30 have an aligned bore 34 with the terminal ends 25 of the arm members 19 are pivotally mounted with a non-compressive screw 32 in juxtaposition to the bosses 30. As described previously, the terminal ends 25 of the arm members 19 are placed along one side 36 of the boss 30. The stop member 39 or 44 extends laterally outwardly from the side 36 of the boss 30. Also as described previously, the stop members 39 and 44 includes an upper concave lip portion 27 and a lower outwardly extending portion 46. Alternate forms of the slider mount are shown in FIGS. 5A, 5B, 6A and 6B, designated as 33' and 33". The boss 30 may include slot members 38 which change the composition of the mounting member, as discussed previously. Also included in the forms of the slider mount 33, 33' and 33" is the adjustable locking member 17 which will be discussed in more detail later.

The truss mounts 22 include upper and lower mounts which are identical, as shown in FIG. 3, and include at least one boss 30, but typically have three bosses and the arm members 19 having the terminal ends 25 pivotally mounted in juxtaposition to the boss 30. Each boss 30 includes a stabilizer member in the form of a stop member 39 or 44 to prevent overextension of the arm members 19. The bosses 30 extend laterally outwardly from the truss mount 22 and the stop members 39 or 44 are juxtapositioned to each boss 30. The stop member 39 or 44 extends laterally from one side 36 of each boss 30. The stop member 39 or 44 has an upper concave lip 27 providing a relief surface for the arm member 19. In another embodiment, including a larger sized canopy, and as shown in FIG. 6, 6A, 6B and FIG. 10, an intermediate vertical support leg 40 is placed between the corner legs 13. Intermediate mounting member 43 is shown with intermediate slider mount 33". At least three bosses 30' extend laterally outwardly from the mounting member 43 and the slider mount 33" (third boss not shown) with bores 34 therethrough designed to accommodate aligned bores on the terminal ends 25 of the arm member 19. The intermediate mounting member 43 and the slider mount 33" includes the stop members 39 and 44 juxtaposed to each boss 30. See FIGS. 6A and 6B. The stop members 39 and 44 extend laterally outwardly from the side 36 of the boss 30'. Rotation of the arm member 19 is accomplished in combination with the non-compressive screw 32 or the bolt member 83 and the pivot shaft 89 for securing the terminal ends 25 of the arm members 19 to the bosses 30' through the aligned bores 34. Overextension of the arm member 19 is prevented and precise alignment is accomplished with the stop members 39 and 44.

Figure 7:
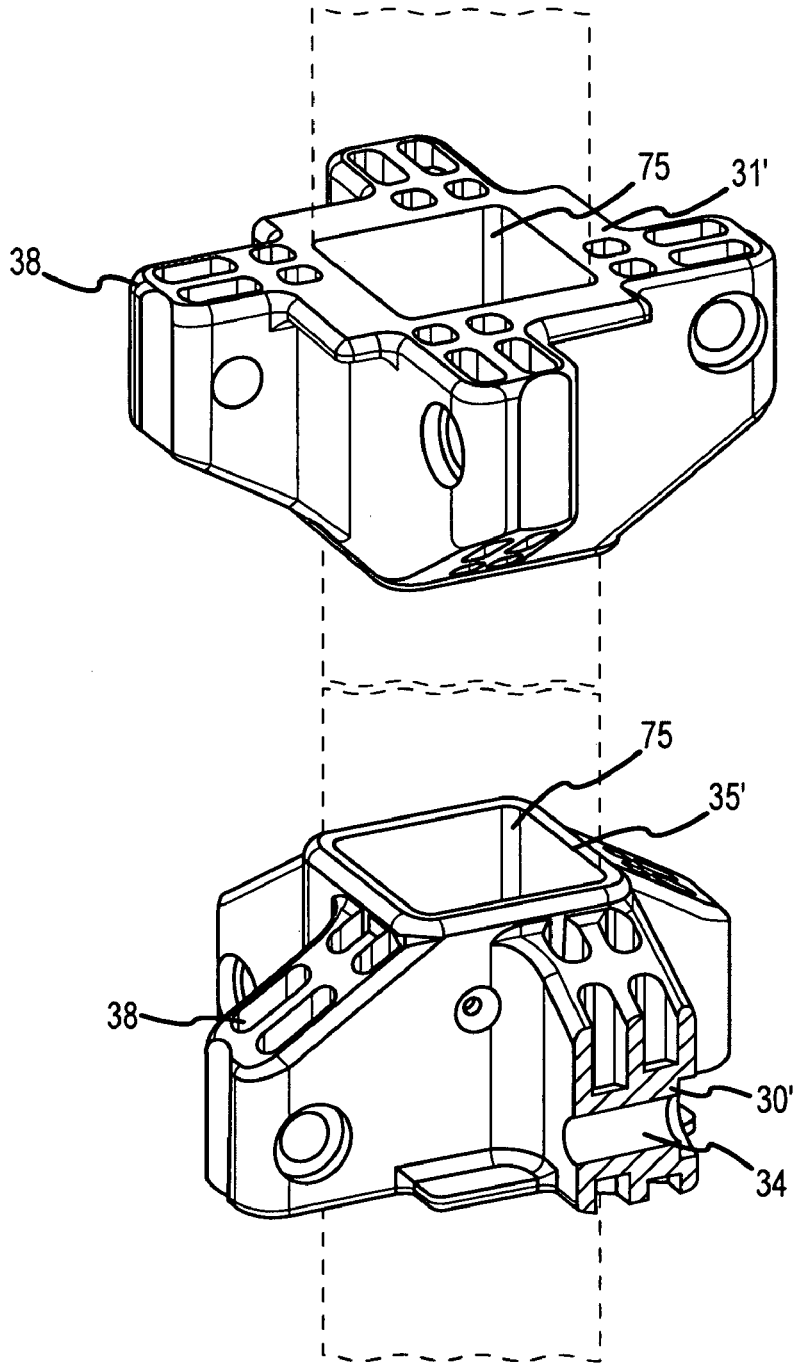
FIG. 7 is a perspective view of an alternate form of center mounting assembly.

FIG. 4 demonstrates the upper center mounting member 31 and the lower center mount 35 each including four bosses 30 extending laterally outwardly from the upper center mounting member 31 and the lower center mount 35 in equally spaced circumferential relation to one another about the common center support 23. FIG. 4 also demonstrates the stop members 39 and 44 extending laterally outwardly from the boss 30. FIG. 7 demonstrates an alternate form of upper center mounting member 31' and lower center mount 35'. The variation in center support configuration and corresponding square opening 75 will be described in more detail. The operation of the stop member 39 is identical to what has been described previously. The lower center mount 35' demonstrates the boss 30' in cross-section. The slot members 38 pass partially through the boss 30' and the bore 34 passes completely through the boss 30. FIG. 8 shows a view in section of the lower center mount 35'.

Figure 6A:
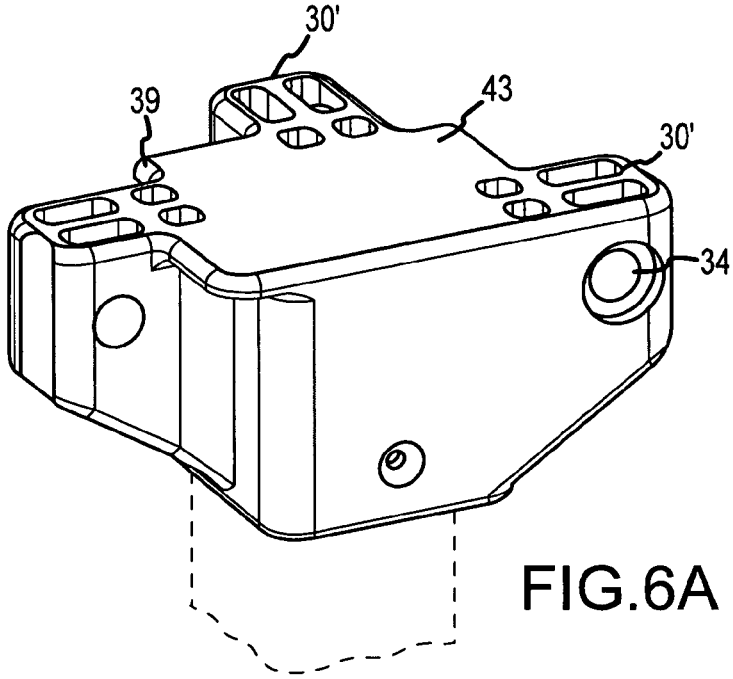
FIG. 6A is a perspective view of an intermediate mounting assembly.
Figure 6B:
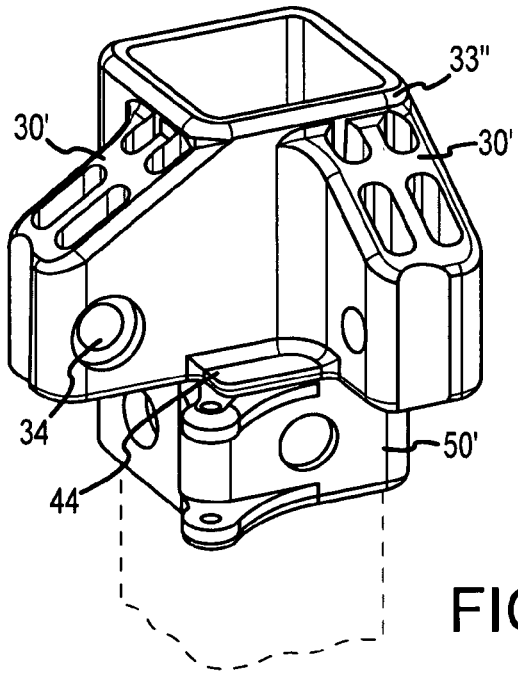
FIG. 6B is a perspective view of an intermediate mounting assembly.
Figure 11:
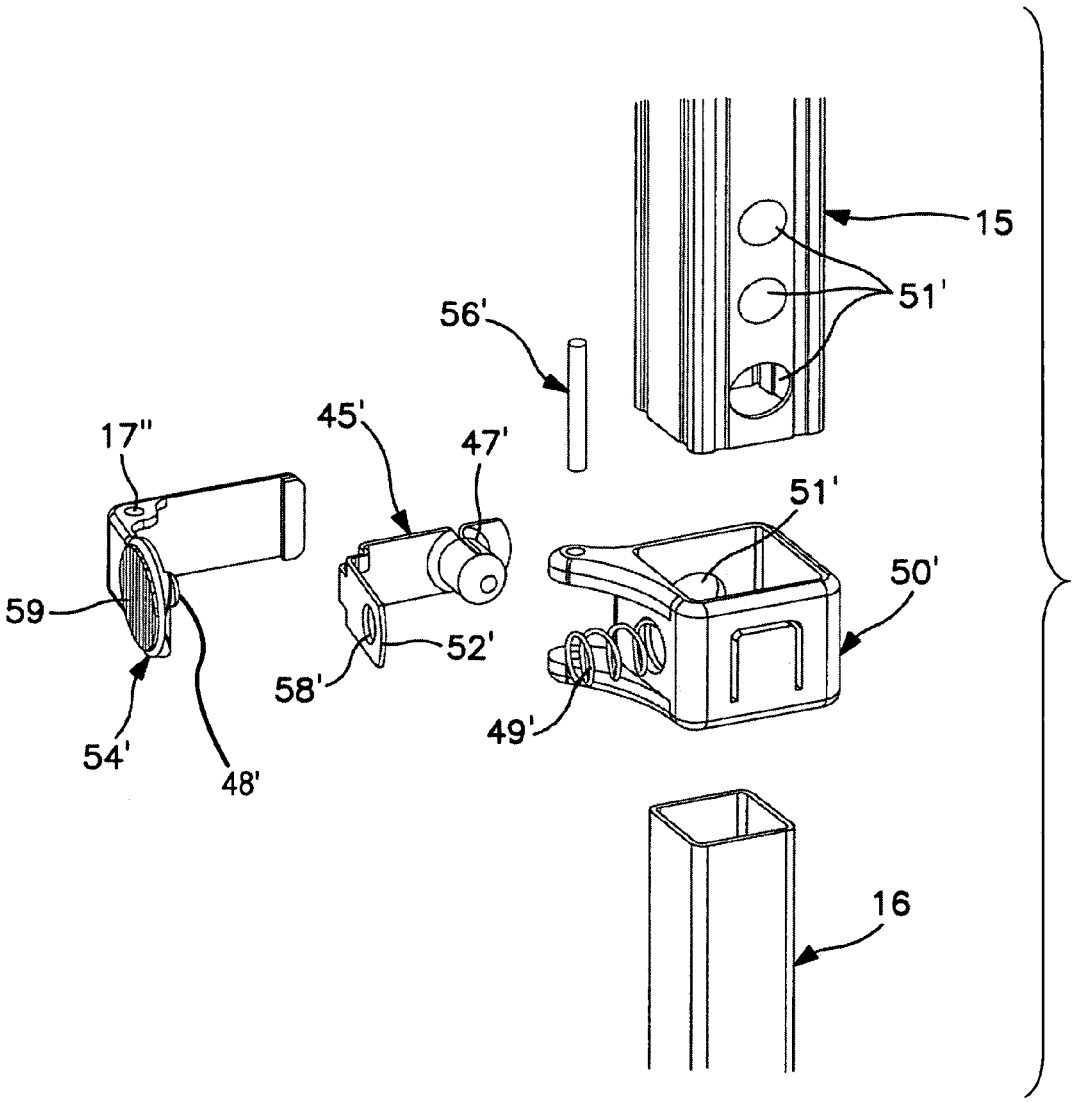
FIG. 11 is an exploded view of an alternate form of invention.

As described previously, the adjustable locking member 17 is shown in FIGS. 2, 5B and 6B in combination with the slider mount 33, 33' and 33". The adjustable locking member or precision locking member 17, as best shown in FIG. 5B, includes right angle lever control 45 having a release or retention pin 47 and a spring member 49 mounted under compression between the right angle lever control 45 and a base mounting member 50. The spring member 49 resiliently urges the right angle lever control 45 in a direction causing the release pin 47 to engage with mutually aligned bores 51 on telescoping member 15. This is shown in FIG. 11 in an alternate form which will be described in detail at a later point. The spring member 49 is mounted on an underside 52 of the right angle lever control or right angle release button 45 and held in place with a pin member (not shown) mounted on a protective sleeve member 57 having opposing side panels 99. The pin member passes through an aligned bore 58 on the right angle lever control 45. The spring member 49 is typically mounted at a right angle to the release pin 47. The right angle lever control 45 also includes a protective sleeve member 57 which prevents dirt and other foreign objects from entering the spring member 49 thereby preventing its operation. The protective sleeve member 50 includes corresponding, opposing side panels 99' with the opposing side panels 99 of the right angle lever member 45. The protective sleeve member 57 and the right angle lever control 45 are held in place with a pin 56. The right angle lever control 45 has a pressure pad 54 which provides a pressure-resistant platform enabling a user to easily press the pad 54 allowing for one-handed operation. The user hears a simple "click" when the release pin 47 is fully engaged with the aligned bores 51. Further, a user may visually observe engagement as the right angle lever control 45 extends outwardly when the release pin 47 engages with the mutually aligned bores 51.

Figure 10:
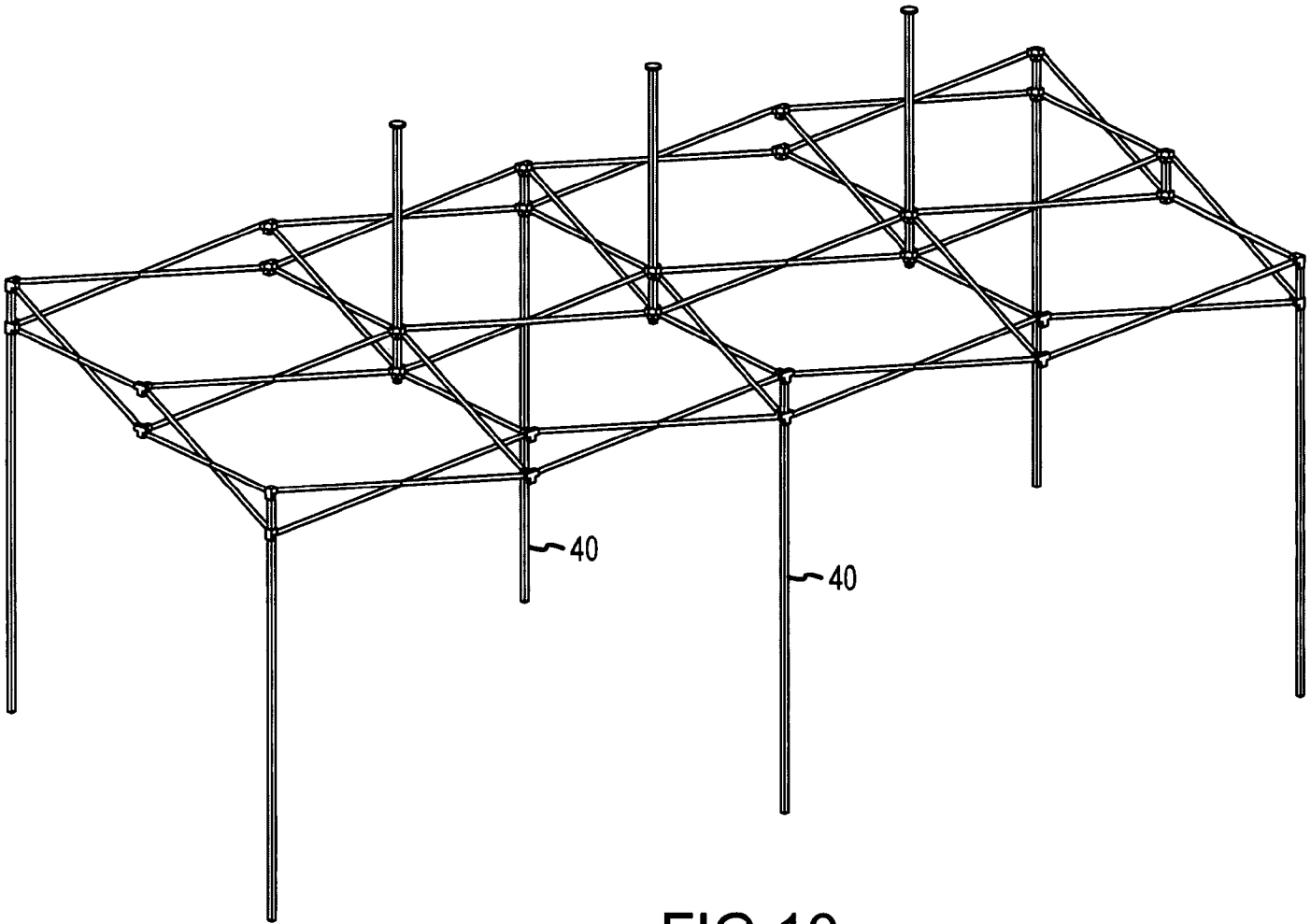
FIG. 10 is a perspective view of a shelter frame of an alternate form of invention.

The adjustable locking member 17 performs a dual function. When mounted in conjunction with the slider mounts 33, 33' and 33" as shown in FIGS. 2, 5B and 6B, the adjustable locking member 17 allows for vertically adjusting the angle of extension between the arm members 19, the slider mount 33 and the center mounting assembly 26. In operation, the adjustable locking member 17 in conjunction with the slider mount 33, is forced upwardly along the corner legs 13. The corner legs 13 have aligned bores 51 with the adjustable locking means 17 and are in a locked position when the release pin 47 engages the mutually aligned bores. This results in the arm members 19 extending to predetermined stop points, providing correct alignment, forming an extended framework as shown in FIG. 1 and FIG. 10.

The second function of the locking member is a vertical height adjustment device 17' as shown in FIG. 2. When adjustable locking member 17' is mounted alone on the corner legs 13, it performs the function of adjusting the vertical height of the corner legs 13. The corner legs 13 include the upper and lower telescoping or slidable sleeve members 15 and 16, respectively as well as a lock stop 9 preventing over-adjustment of the locking member 17, 17'. The adjustable locking member 17' is mounted at a lower terminal end 53 of the upper telescoping leg member 15. The adjustable locking members 17 and 17' as shown in FIG. 2 show the locking members 17 and 17' in the locked position.

Another form of the adjustable locking member 17" as shown in FIG. 11 includes a right angle lever control 45' having a release pin 47' and a spring member 49' mounted under compression between the right angle lever control 45' and a base mounting tube member 50'. As described previously, the spring member 49' resiliently urges the right angle lever control 45' in the direction causing the release pin 47' to engage with mutually aligned bores 51' on the tube 50' and telescoping member 15. The spring member 49' is mounted on an underside 52' of the right angle lever control 45' and held in place with a pin member 48' which passes through an aligned bore 58' of the right angle lever control 45'. The adjustable locking member 17" also includes a lever 59 which includes a pressure pad 54' and is held in place along with the right angle lever control 45' with a pin 56'. The base mounting member 50' is shown in conjunction with the intermediate slider mount 33" of FIG. 6. The adjustable locking member 17, and alternate form 17" may be used interchangeably in conjunction with slider mounts 33, 33' and 33" and as the vertical height adjustment device 17'.

In practice, the canopy 12 is erected by increasing the angle of extension between the corner leg mounting member 29, the slider mounts 33 and the arm members 19. An adjustable tension assembly as described in applicant's U.S. Pat. No. 5,490,532 and incorporated by reference herein may be used in conjunction with an upper center mount and lower center mount 31' and 35', respectively. Alternatively, another form of center post assembly 71, which is well known in the prior art, is illustrated in FIGS. 4 and 10 and includes upper and lower telescoping members 73 and 74, respectively. The telescoping members are generally of circular cross-section and the upper telescoping member 73 has an end cap 77 at its upper terminal end which engages the undersurface of the canopy 12 at its center. A coiled spring member (not shown) is mounted under compression between the lower center mount 35 with a stop member (not shown). In a conventional manner, twisting of the upper and lower telescoping members 73 and 74 results in an increase or decrease in the overall tautness of the canopy 12.

FIG. 4 shows the upper center mounting member 31 and the lower center mount 35 used in conjunction with the conventional twisting adjustment having a coiled spring member as described in U.S. Pat. No. 5,275,188 to Tsai. FIG. 7 demonstrates the upper center mounting member 31' and the lower center mount 35' to be used with the adjustment tension assembly described in U.S. Pat. No. 5,490,532 and incorporated by reference herein. The upper and lower mounts 31' and 35' have a square mounting opening 75 with slot members 38 making it more lightweight as well creating a precise assembly. The upper center mounting member 31' is mounted on upper and lower telescoping tubular members (not shown) which are generally rectangular or square cross-section. The lower center mount 35' as shown in FIG. 7 is used in conjunction with the upper center mounting member 31' and the adjustable tension assembly as described above. As described previously, FIG. 8 demonstrates the upper center mounting member 31' in cross-section, clearly showing the slot members 38.

Although all forms of invention have been described specifically in relation to use with a collapsible shelter, it is to be understood that the mounting assembly and adjustable locking member are readily adaptable for use with other types of frames.

It is therefore to be understood that while preferred forms of invention are herein set forth and described, the above and other modifications may be made therein without departing from the spirit and scope of the invention as defined by the appended claims and reasonable equivalents thereof.

We claim:

1. In a shelter having a canopy, support members including vertical support legs at spaced peripheral intervals beneath said canopy, a center support extending upwardly from said vertical support legs into telescoping engagement with an undersurface portion of said canopy at its center and truss sections extending from said vertical support legs and said center support and including a pair of arm members with terminal ends connected to said support members, the improvement comprising:

mounting members at said terminal ends of said arm members including a mounting base;

said mounting base having at least one boss, means for pivotally connecting said arm members to said at least one boss, said means including a bolt member threadedly engaging a hollow shaft member extending through said at least one boss;

wherein said at least one boss includes means for limiting pivotal movement of said arm members, said limiting means including a limit stop member extending laterally and outwardly from an exterior of said boss, wherein said limit stop member is configured for wedging said arm member against movement with respect to said at least one boss.

2. In a shelter according to claim 1 wherein said at least one boss includes slot members.

3. In a shelter according to claim 1 wherein said at least one boss extends laterally outwardly from said mounting members.

4. In a shelter according to claim 1 wherein said limit stop member interlocks with said arm member.

5. In a shelter according to claim 1 wherein said arm member includes a collar at one end.

6. In a shelter according to claim 1 wherein said pivotally connecting means includes the bolt member and the hollow shaft member inserted through aligned bores on said terminal ends of said arm members and said boss.

7. In a shelter according to claim 1 wherein said pivotally connecting means includes the hollow shaft member being a fixed hollow pivot shaft, and the bolt member being a hex bolt.

8. A device for locking telescoping members into place comprising:

an adjustable locking member defined by a right angle lever control including a release pin and a spring member mounted under compression between said right angle lever control and a base mounting member, wherein said spring member is mounted at a right angle to said release pin, said spring member resiliently urging said right angle lever control in a direction causing said release pin to engage mutually aligned bores on said telescoping members, and wherein said spring member is mounted on an underside of said right angle lever control.

9. A device according to claim 8 wherein each of said telescoping members has a lower end, and wherein the adjustable locking member is adapted to be mounted on a respective lower end of said telescoping members.

10. A device according to claim 8 wherein said right angle lever control includes a protective sleeve member.

11. In a shelter assembly having vertical support members, a center support structure and arm members interconnecting said vertical support members and said center support structure, the improvement comprising:

an adjustable locking member for adjusting the angle of extension between said arm members, said vertical support members and said center support structure; and said adjustable locking member defined by a base member, a right angle lever member including a push member located at a right angle to a retention pin, a spring member mounted below a pin member on said push member resiliently urging said pin member in a direction causing said retention pin to engage with mutually aligned bores on said vertical support members.

12. In a shelter assembly according to claim 11 wherein said right angle lever member includes opposing side panels.

13. In a shelter assembly according to claim 12 wherein said base member includes corresponding, opposing side panels with said opposing side panels of said right angle lever member.

14. In a shelter assembly according to claim 11 wherein said right angle lever member includes a pressure pad.

15. In a shelter having a canopy being surmounted on a collapsible frame, said frame having support members including vertical support legs, a center support extending upwardly into engagement with an undersurface of said canopy and truss members, the improvement comprising:

means for positioning said frame in an upper locked position;

said vertical support legs including upper and lower slidable sleeve members having mutually aligned bores, an upper terminal end of said upper sleeve member engaging said undersurface of said canopy;

a base mounting member mounted on said vertical support leg, said base mounting member having a bore, and said position locking means defined by a spring member mounted under compression between a right angle pin lever member and said base mounting member, wherein said spring member is mounted at a right angle to said pin lever member, said spring member resiliently urging said pin lever member in a direction causing a retention pin mounted on an opposite end of said pin lever member to engage with said aligned bores on said sleeve members and said bore on said base mounting member, and wherein said retention pin is mounted at a right angle to said spring member.

16. In a shelter according to claim 15 wherein said position locking means is mounted near said upper terminal end of said upper sleeve member.

17. In a shelter according to claim 15 wherein said upper terminal end of said upper sleeve member includes a lock stop.

18. In a shelter a canopy being surmounted on a frame, said frame having vertical support legs, a center support extending outwardly into engagement with an undersurface of said canopy and truss sections having arm members extending from said vertical support legs and said center support, the improvement comprising:

means mounted for adjusting the height of said vertical support legs;

said vertical support legs including upper and lower slidable sleeve members having mutually aligned bores; and a base mounting member mounted on said vertical support leg, said base mounting member having a bore, and said adjusting means defined by a right angle release button having a spring member mounted under compression between said right angle release button and said base mounting member, said spring member resiliently urging said right angle release button in a direction causing a retention pin mounted on said release button to engage with said mutually aligned bores on said sleeve members and said bore on said base mounting member, and wherein said retention pin is mounted at a right angle to said spring.

19. In a shelter having a canopy and a collapsible frame including vertical support legs at spaced peripheral intervals beneath said canopy and a telescoping center support member and truss sections extending from said vertical support legs and said center support including arm members having terminal ends, the improvement comprising:

slidable mounting members located on an upper end of said vertical support legs;

said mounting members each having at least two bosses with a bore therethrough, said arm members including an aligned bore and pivotally mounted in juxtaposition to said bosses;

position locking members included on said mounting members for increasing the angle of extension between said vertical support legs and said arm members;

said vertical support legs having mutually aligned bores; and said position locking members defined by a spring member mounted under compression between a right angle pin lever member and a base mounting member, said spring member resiliently urging said pin lever member in a direction causing a retention pin mounted on an opposite end of said pin lever member to engage with said aligned bores, wherein said retention pin is mounted at a right angle to said spring member, and wherein said vertical support legs include a lock stop secured to an upper terminal end of said vertical support leg.

20. In a shelter according to claim 19 wherein said bosses include a stabilizer member extending laterally outwardly from an outer side surface of said bosses.

21. In a shelter according to claim 19 wherein said pin lever member includes a protective sleeve.

22. In a shelter assembly having telescoping vertical support legs at spaced peripheral intervals beneath a canopy, a telescoping center support member, and including truss sections provided with arm members, the improvement comprising:

a first end of said arm members connected to a free mounting member;

a second end of said arm members connected to mounting members on said vertical support legs or said center support member, each said mounting member and said free mounting member having at least one boss with a first bore extending therethrough;

said first and second ends of said arm members each having a bore aligned with said first bore and pivotally mounted in juxtaposition to said boss; and a stabilizing member extending laterally from each said boss into the path of pivotal movement of each said arm member, wherein said stabilizing member includes an upper concave lip portion and a lower outwardly extending portion.

23. In a shelter assembly according to claim 22 wherein said upper concave portion has a curved side wall.

24. In a shelter assembly according to claim 22 wherein said first end of said arm members is pivotally mounted along an outer side surface area of said boss.

25. In a shelter assembly according to claim 22 wherein said second end of said arm members is pivotally mounted on an outer side surface area of said boss.

26. In a shelter assembly according to claim 25 wherein said boss includes a hexagonal seat portion.

* * * * *

UNITED STATES PATENT AND TRADEMARK OFFICE

CERTIFICATE OF CORRECTION

PATENT NO. : 7,409,963 B2
APPLICATION NO. : 10/983005
DATED : August 12, 2008
INVENTOR(S) : Steven E. Mallookis and Chao-Shun Ko It is certified that error appears in the above-identified patent and that said Letters Patent is hereby corrected as shown below:

In the Specification:

Column 6, lines 46-47, cancel "The protective sleeve member 50" and substitute therefor -- The base mounting member 50 --.

Signed and Sealed this

Twenty-first Day of October, 2008

JON W. DUDAS
*Director of the United States Patent and Trademark Office*